US006564529B2

(12) United States Patent
Reinecke

(10) Patent No.: US 6,564,529 B2
(45) Date of Patent: May 20, 2003

(54) BOTTLE-CAPPING SYSTEM

(75) Inventor: Günter Reinecke, Solingen (DE)

(73) Assignee: SIG Hamba Filltec GmbH & Co. KG, Neunkirchen/Saar (DE)

( * ) Notice: Subject to any disclaimer, the term of this patent is extended or adjusted under 35 U.S.C. 154(b) by 224 days.

(21) Appl. No.: 09/825,168

(22) Filed: Apr. 3, 2001

(65) Prior Publication Data

US 2001/0032437 A1 Oct. 25, 2001

(30) Foreign Application Priority Data

Apr. 4, 2000 (DE) ..... 100 16 666

(51) Int. Cl.[7] ..... B65B 7/28
(52) U.S. Cl. ..... 53/303; 53/307
(58) Field of Search ..... 53/302–304, 307

(56) References Cited

U.S. PATENT DOCUMENTS

| | | | | |
|---|---|---|---|---|
| 2,680,549 A | * | 6/1954 | Levy | 53/303 |
| 3,939,625 A | * | 2/1976 | Remele et al. | 53/307 |
| 4,848,060 A | * | 7/1989 | Kubis et al. | 53/307 |
| 5,054,260 A | | 10/1991 | Herzog | |

FOREIGN PATENT DOCUMENTS

| | | |
|---|---|---|
| DE | 1 532 500 | 2/1972 |
| DE | 24 18 893 | 10/1975 |
| DE | 197 27 942 | 1/1999 |
| FR | 2 302 961 | 10/1976 |

* cited by examiner

*Primary Examiner*—Stephen F. Gerrity
(74) *Attorney, Agent, or Firm*—Herbert Dubno; Amdrew Wilford

(57) ABSTRACT

A bottle-capping machine has a rotor rotatable about a substantially stationary horizontal axis and having radially oppositely outwardly directed arms each having an outer end formed as a seat adapted to hold one of the caps. A conveyor moves the bottles through a fitting station below the axis and a downwardly open magazine holding a stack of the caps in a pick-off station above the axis is vertically displaceable between a lower position with the stack engageable with the seat in the pick-off station and an upper position with the stack clear of the seat in the pick-off station. A vertically displaceable stripper element fixed to the magazine is engageable with the cap on the seat in the fitting station to strip the cap from the seat in the fitting station and apply it to the neck of a bottle in the fitting station.

11 Claims, 2 Drawing Sheets y
23
24
z
39
26
22
27
27
10
50
M
30
29
19
28
25
A
19
38
$H_2O_2$
11
II
21
U
F
B
20
30
48
49
19
30
31
V
20
47
35
30
31
C
20
20
38
30
33
L
E
32
D
32
37
32
30
14
45
15
12
III
14
15
17
17
13
16
x
16

18
18

BOTTLE-CAPPING SYSTEM

SPECIFICATION

1. Field of the Invention

The present invention relates to capping bottles. More particularly this invention concerns an automatic machine for capping bottles or the like.

2. Background of the Invention

A standard bottle-capping machine has a conveyor that displaces a row or several rows of filled bottles with their necks open upward through a fitting station below a rotor rotatable about a horizontal axis. This rotor has a plurality of radially projecting arms each with an outer end forming a seat that is connectable to a vacuum line. A downwardly open magazine fixed above the rotor holds a stack of caps. The seat-forming outer ends of the arms are constructed to move radially on the arms by means of a complex actuator system so that, when each arm is below the magazine, its end can extend outward and pick a cap off the bottom of the stack in the magazine and then retract inward to pull it from the magazine and, when each arm is in the fitting station, the end can extend again to fit the cap to the bottle beneath it and then retract once the cap is solidly mounted on the bottle. The caps are made primarily of a metallic foil so they can be crimped onto the open mouths of the bottle necks.

Such a machine is quite complex. The arms, which can be provided in, for instance, six rows, are all complicated mechanisms that all must function perfectly every time or the entire machine is down. Hence the machine is very expensive and must be meticulously maintained to ensure that every cap is perfectly fitted.

OBJECTS OF THE INVENTION

It is therefore an object of the present invention to provide an improved bottle-capping machine.

Another object is the provision of such an improved bottle-capping machine which overcomes the above-given disadvantages, that is which is relatively simple but which still functions surely and smoothly.

SUMMARY OF THE INVENTION

A machine for applying caps to bottles has according to the invention a rotor rotatable about a substantially stationary horizontal axis and having two radially oppositely outwardly directed arms each having an outer end formed as a seat adapted to hold one of the caps. The seats orbit on rotation of the rotor through a fitting station underneath the axis and through a pick-off station above the axis. A conveyor moves the bottles through the fitting station with necks of the bottles directed upwardly toward the axis. A downwardly open magazine holding a stack of the caps in the pick-off station is vertically displaceable between a lower position with the stack engageable with the seat in the pick-off station and an upper position with the stack clear of the seat in the pick-off station. A vertically displaceable element engageable with the cap on the seat in the fitting station can move between and upper position and a lower position for stripping the cap from the seat in the fitting station and applying it to the neck of a bottle in the fitting station. The element and magazine are coupled together for joint vertical movement between the respective upper and lower positions. A drive jointly displaces the stack and element for simultaneously engaging the stack with the seat in the pick-off station and stripping the cap from the seat in the fitting station.

Thus the rotor can be a relatively simple structure, with each arm being an essentially rigid, one-piece part whose outer end forms the seat which cannot move relative to the stationary rotor axis. Instead, the magazine and the stripping/crimping element are moved.

Structure constituted as a frame couples the magazine to the element. This frame is fixed to the magazine and downwardly directly engageable with the element.

In accordance with the invention means is provided for aspirating air through the seats and thereby adhering the caps thereto. Once an arm is in the fitting station above the bottle to be capped, the vacuum can be cut to allow the cap to be stripped easily from the seat and pushed down on the bottle.

The stripping element according to the invention is a respective sleeve surrounding an outer end of each of the arms and radially displaceable between an outer position projecting radially outward past the seat and an inner position radially inward of the seat. The sleeve has a radially outwardly projecting flange that is engaged by the frame as it is bumped down to lower the magazine. To further simplify the structure respective springs on each arm biasing the respective sleeves radially inward. The sleeve is shaped to crimp the caps around the bottle necks.

The arms are diametrically offset from each other relative to the axis. Normally there are a plurality of such arms equiangularly offset from each other. The machine further has according to the invention a drive for displacing the rotor through angular steps equal to the angular spacing between the arms.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
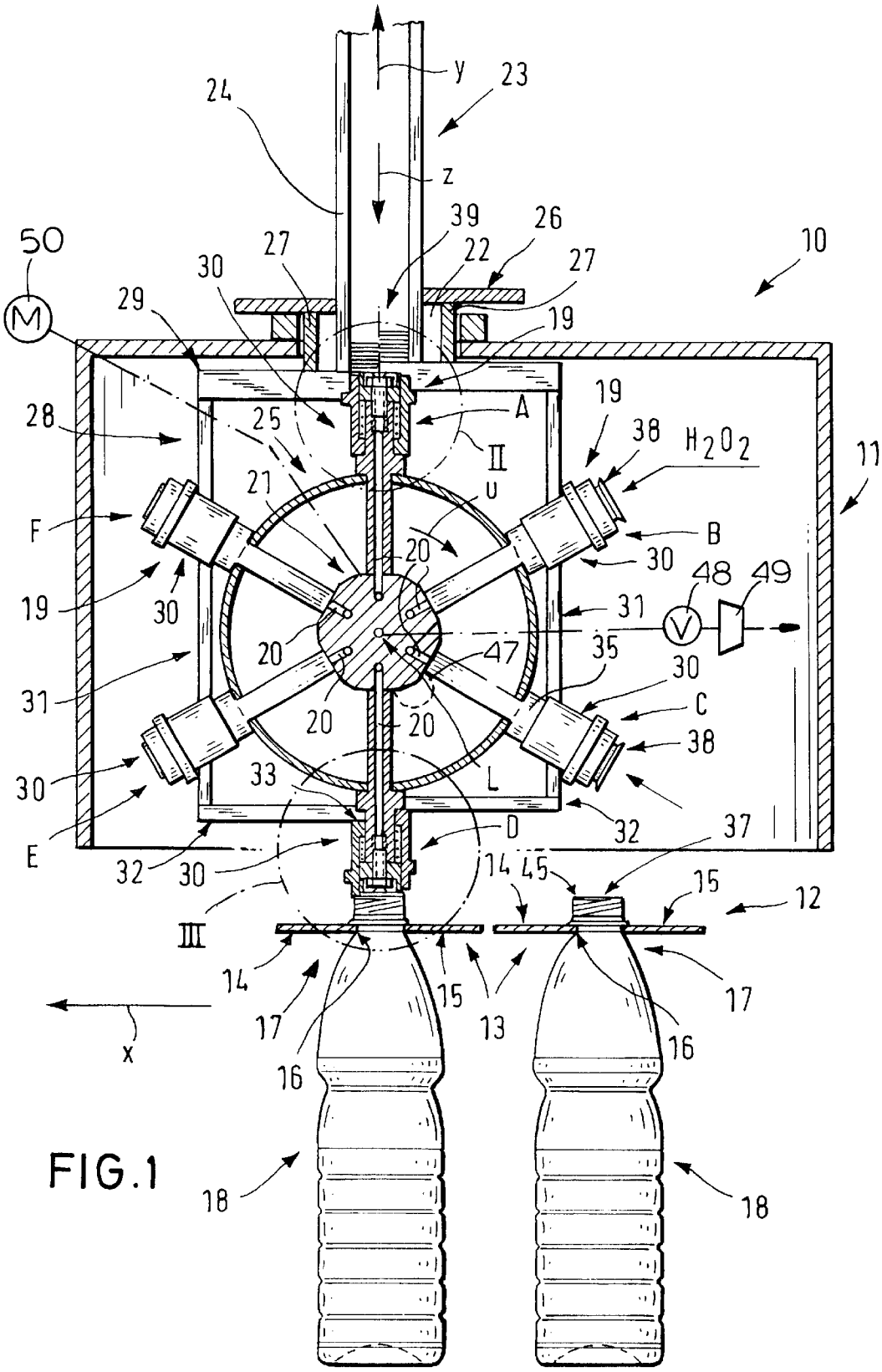
FIG. 1 is a partly diagrammatic vertical section through the apparatus according to the invention.
Figure 3:
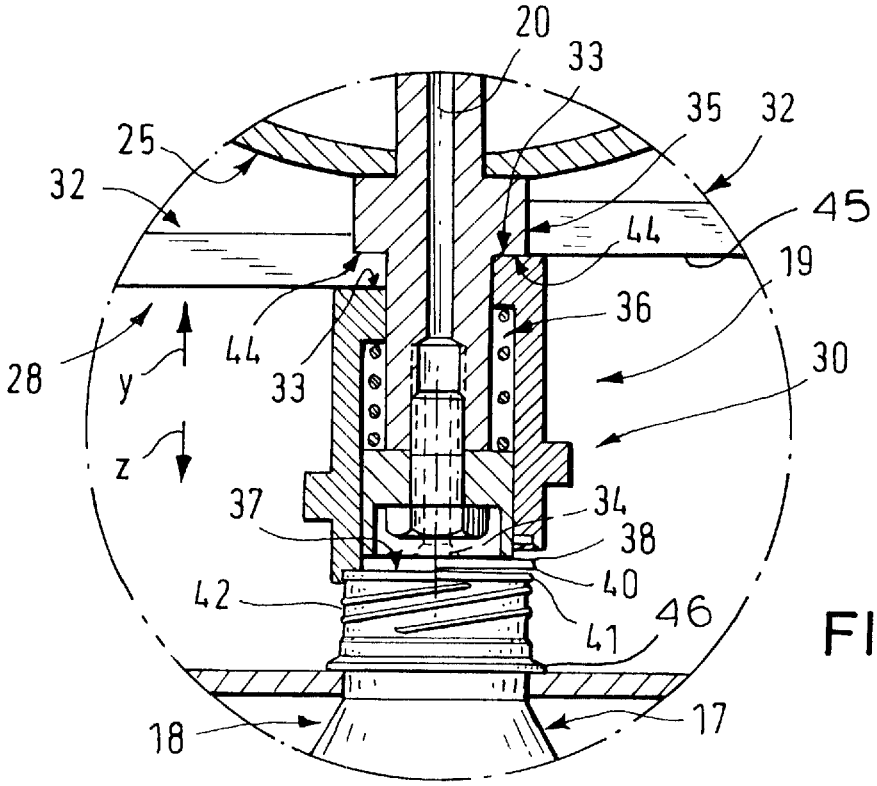

As seen in FIG. 1 a capping machine 10 according to the invention has a stationary housing 11 positioned above a conveyor 12 comprised of a plurality of holders 13 each formed by a pair of plates 14 and 15 together forming seats 16 for necks 17 of bottles 18 that hang from these holder 13. These bottles 18 are filled, typically with a liquid drink or foodstuff. The conveyor 12 advances in steps in a horizontal transport direction x to position the bottles 18 below a horizontal axis L of a rotor 21 of the machine 10. It would also be possible for the conveyor 12 to carry a row of bottles 18, with each row extending horizontally transverse to the transport direction x. As shown in FIG. 3 each bottle neck 17 has at its outer end an outwardly projecting rim or lip 41, another rim 46 by means of which it hangs on the respective holder 13, and a screwthread 42 therebetween.

The rotor 21 has six angularly equispaced and radially outwardly extending arms 19 seated in a cylindrical drum 25 and each formed with a passage 20 through which air can be aspirated in accordance with rotor position as controlled by a slide valve indicated schematically at 48 and connected to the input of a pump 49. This rotor 21 is stepped rotationally in a clockwise direction u by a motor illustrated schematically at 50 and carries a cam having a plurality of bumps one of which is illustrated at 47.

Figure 2:
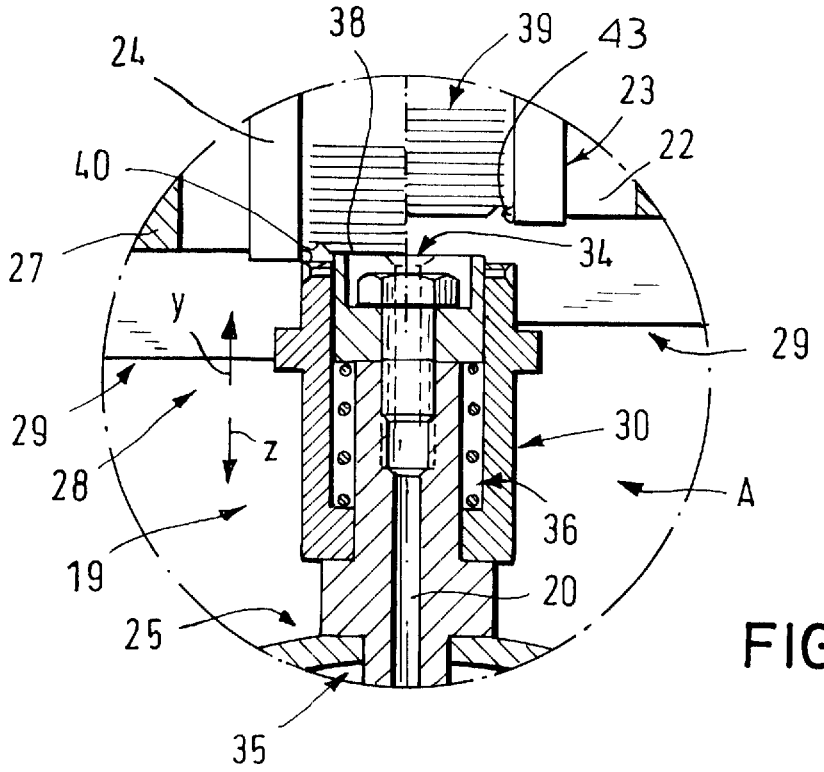
FIGS. 2 and 3 are large-scale views of the details indicated at II and III, respectively, in FIG. 1.

At its upper side the stationary housing 11 has a port 22 through which extends a magazine assembly 23 having an upright tubular magazine 24 carrying a stack 39 of individual disk-shaped foil caps 38 having outer peripheries 40. A lower end of the magazine 24 has bumps 43 that prevent the caps 38 from dropping out of its lower end. The magazine 24 is carried on a plate 26 having legs or spacer plates 27 connected to a frame 28 inside the housing 11 and comprising upper horizontal members 29, vertical side members 31, and horizontal lower members 33. The cam bumps 47 coact with the frame 28 such that each time the rotor 21 comes into a position with one of its arms 19 extending straight up from the axis L in a pick-off station A and the opposite arm 19 extending straight down in a fitting station D, the frame 28 drops momentarily, into the position illustrated to the left in FIGS. 1, 2, and 3, and as soon as it starts to move out of this position, it lifts again to the position illustrated to the right in FIGS. 1, 2, and 3.

The outer end of each arm 19 carries a capping sleeve 30 that is displaceable radially on the arm 19 and that has an outer end formed as a seat 34 adapted to fit complementarily with the cap disks 38 and an inner end 33 buttable against a shoulder surface 44 of a collar 35 of the respective arm 19 or in the station D against a lower surface 45 of the arms 32. Respective springs 36 urge the sleeves 30 radially inward, into engagement with the surface 44 or 45.

This system functions as follows:

As the rotor 21 moves in steps in the direction u into the position of FIG. 1, one of the cam bumps 47 pushes down the frame 28 and other unillustrated means opens the valve 48 for the arm 19 moving into the pick-off station A. This action lowers the magazine 24 so that the lowermost cap disk 38 is pressed onto the seat 34 of the sleeve 30 where the suction created by the pump 49 in the respective passage 20 holds it solidly in place therein. As the rotor 21 is stepped to a station B 60° offset in the direction u, one of the cam bumps 47 again raises the magazine 24 so that the bottommost cap disk 38 is pulled past the bumps 43 and is carried angularly off to the station B.

In the station B appropriate means spray peroxide ($H_2O_2$) on the cap 38. The valve 48 remains open for the passage 20 of the arm 19 carrying the picked-off cap disk 38 so that it remains solidly seated on the sleeve 30 which is pressed by its spring 36 against the collar surface 44. As the cap disk 38 is sterilized in the station B another cap disk 38 is picked off the bottom of the stack 39 by the following arm 19.

The cap 38 carried by the arm 19 is then orbited through the station C where hot sterile air is blown on it to dry off the hydrogen peroxide, while of course the following cap 38 is being sprayed and the arm 19 following that picks off another cap 38.

Finally the arm 19 moves into station D where, when one of the cam bumps 47 again raises and lowers the frame 28, the lower surfaces 45 of the frame 28 engage the sleeve 30 and push it against the force of its spring down as shown in FIG. 3 to press the disk 38 tightly against the mouth 17 of the bottle 18. At the same time the valve 48 for the passage 20 of the arm 19 in the station D is moved to vent the seat 34 and allow the cap 38 to disengage from the seat 34, an action that is aided by the fact that the cap 38 is clinched by the sleeve 30 to the bottle neck 17.

During the next two angular steps of the arm 19 which now has an empty seat 34, it passes through stations E and F where nothing happens. Then it reenters station A and the cycle is repeated.

Thus the up-and-down movement of the frame 28 has the simultaneously effect of lowering the magazine 24 to fit a cap disk 38 to the seat 34 of the arm 19 in the station A and press a cap disk 38 carried by the arm 19 in the station D down onto a bottle 18. The action is simple and easy to control, ensuring that the capping process takes place smoothly with a minimum of control technology.

I claim:

1. A machine for applying caps to bottles, the machine comprising:

a rotor rotatable about a substantially stationary horizontal axis and having two radially oppositely outwardly directed arms each having an outer end formed as a seat adapted to hold one of the caps, the seats being orbital on rotation of the rotor through a fitting station underneath the axis and a pick-off station above the axis;

a conveyor for displacing the bottles through the fitting station with necks of the bottles directed upwardly toward the axis;

a downwardly open magazine holding a stack of the caps in the pick-off station and vertically displaceable between a lower position with the stack engageable with the seat in the pick-off station and an upper position with the stack clear of the seat in the pick-off station;

means including a vertically displaceable element engageable with the cap on the seat in the fitting station and movable between an upper position and a lower position for stripping the cap from the seat in the fitting station and applying it to the neck of a bottle in the fitting station;

means for coupling the element and magazine together for joint vertical movement between the respective upper and lower positions; and drive means for jointly displacing the stack and element for simultaneously engaging the stack with the seat in the pick-off station and stripping the cap from the seat in the fitting station.

2. The bottle-capping machine defined in claim 1 wherein the coupling means is structure.

3. The bottle-capping machine defined in claim 2 wherein the structure is a frame fixed to the magazine and downwardly directly engageable with the element.

4. The bottle-capping machine defined in claim 1, further comprising means for aspirating air through the seats and thereby adhering the caps thereto.

5. The bottle-capping machine defined in claim 4 wherein the element is a respective sleeve surrounding an outer end of each of the arms and radially displaceable between an outer position projecting radially outward past the seat and an inner position radially inward of the seat.

6. The bottle-capping machine defined in claim 5 wherein the sleeve is shaped to crimp the caps around the bottle necks.

7. The bottle-capping machine defined in claim 5, further comprising respective springs on each arm biasing the respective sleeves radially inward.

8. The bottle-capping machine defined in claim 1 wherein the arms are diametrically offset from each other relative to the axis.

9. The bottle-capping machine defined in claim 1 wherein the arms are equiangularly offset from each other, the machine further comprising:

drive means for displacing the rotor through angular steps equal to the angular spacing between the arms.

10. The bottle-capping machine defined in claim 1 wherein the seats are radially nondisplaceable relative to the axis.

11. A machine for applying caps to bottles, the machine comprising:

a rotor rotatable about a substantially stationary horizontal axis and having a plurality of angularly offset radially oppositely outwardly directed arms each having an outer end formed as a seat adapted to hold one of the caps;

drive means for angularly stepping the arm through angularly offset positions in each of which one of the arms has its seat directed downward in a fitting station underneath the axis and another of the arms has its seat directed upward in a pick-off station above the axis;

a conveyor for displacing the bottles through the fitting station with necks of the bottles directed upwardly toward the axis;

a downwardly open magazine holding a stack of the caps in the pick-off station and vertically displaceable between a lower position with the stack engageable with the seat in the pick-off station and an upper position with the stack clear of the seat in the pick-off station;

means including a vertically displaceable element engageable with the cap on the seat in the fitting station and movable between an upper position and a lower position for stripping the cap from the seat in the fitting station and applying it to the neck of a bottle in the fitting station;

structure coupling the element and magazine together for joint vertical movement between the respective upper and lower positions; and drive means for jointly displacing the stack and element for simultaneously engaging the stack with the seat in the pick-off station and stripping the cap from the seat in the fitting station and applying it to the bottle in the fitting station.

* * * * *